United States Patent [19]
Braid

[11] 4,309,293
[45] Jan. 5, 1982

[54] PROCESS FOR REDUCING THE CORROSIVITY OF PHENOL SULFIDES

[75] Inventor: Milton Braid, Westmont, N.J.

[73] Assignee: Mobil Oil Corporation, New York, N.Y.

[21] Appl. No.: 102,209

[22] Filed: Dec. 10, 1979

[51] Int. Cl.[3] ..... C10M 1/42; C10M 1/38; C10M 5/22; C10M 7/40

[52] U.S. Cl. ..... 252/48.2; 252/78.1; 252/393; 252/395; 568/23; 568/25; 568/48

[58] Field of Search ..... 568/25, 23, 48; 252/48.2, 78.1, 393, 395

[56] References Cited

U.S. PATENT DOCUMENTS

| | | | |
|---|---|---|---|
| 2,249,626 | 7/1941 | Cook et al. | 252/48.2 |
| 2,322,376 | 6/1943 | McCleary et al. | 252/48.2 |
| 2,488,134 | 11/1949 | Mikeska et al. | 252/48.2 |
| 2,769,784 | 11/1956 | Young et al. | 252/48.2 |
| 3,269,980 | 8/1966 | Heuck et al. | 568/25 |
| 3,294,760 | 12/1966 | Hay | 568/25 |
| 3,839,438 | 10/1974 | Hayashi | 568/25 |
| 3,978,137 | 8/1976 | Frame | 568/25 |

*Primary Examiner*—Delbert E. Gantz
*Assistant Examiner*—Irving Vaughn
*Attorney, Agent, or Firm*—Charles A. Huggett; Michael G. Gilman; James D. Tierney

[57] ABSTRACT

Sulfurized phenols, e.g., phenol sulfides, disulfides or polysulfides, oligomers thereof or mixtures of same when treated with alkyl vinyl ethers provide excellent metal anti-corrosivity characteristics without significant reduction of antioxidant, antiwear or other desired properties when incorporated into organic media such as lubricants.

16 Claims, No Drawings

PROCESS FOR REDUCING THE CORROSIVITY OF PHENOL SULFIDES

BACKGROUND OF THE INVENTION

1. Field of the Invention

This invention is directed to the discovery that sulfurized phenols, i.e., phenol sulfides, disulfides, polysulfides and oligomers thereof as well as mixtures of the foregoing prepared for example by reaction phenol with sulfur halides are oxidation inhibitors, antiwear and extreme pressure additives for organic compositions such as oils of lubricating viscosity, solid lubricants such as greases prepared from said oils and functional fluids such as hydraulic fluids. This invention is more particularly directed to a method of improving the anti-corrosion properties of lubricant compositions containing said sulfurized phenols comprising treating said sulfurized phenols with alkyl vinyl ethers thereby making them far less corrosive or even non-corrosive to metals, particularly to copper or copper-containing alloys.

2. Description of the Prior Art

Phenol sulfides, phenols disulfides, polysulfides, and mixtures thereof as well as oligomers thereof are commonly known as "sulfurized phenols" have been previously described in the prior art as oxidation inhibitors, antiwear additives and load carrying additives for lubricants. These sulfurized phenols or phenol sulfides were generally found to be corrosive to metals such as copper and copper alloys which are widely used as bearings and bearing liners. In order to make use of the aforementioned phenol sulfides and sulfurized phenols in lubricants co-additives have been required to protect against such metal corrosion. These co-additives have included metal passivators such as benzotriazole, toluotriazole, and other substituted triazoles, and copper corrosion inhibitors such as bis-tertiary-alkyl disulfide derivatives of 1,3,4-thiadiazoles and 1,2,5-thiadiazoles as well as derivatives of 2-mercaptobenzothiazole. The use of such co-additives is expensive and the source of further complications in lubricant formulations. For example, such use may require solubilizers, or the use of such co-additives may require an additional step in blending the lubricant formulations.

The copper strip test is frequently and widely used to determine the corrosive properties of lubricants and lubricant additives and has been a major disqualifier of phenol sulfide additives. Elemental sulfur present in the product mix, either dissolved or loosely bound, may be responsible for poor copper strip ratings. Corrosive sulfur may also be produced by (e.g., thermal or catalyzed) extrusion from phenol di- and polysulfides. Several methods to resolve the corrosion problem have been explored. However, the present invention directed specifically to a method of controlling or inhibiting the corrosion of copper or copper containing metals (e.g., brass) has not been previously disclosed by any prior art references known to applicant.

SUMMARY OF THE INVENTION

In accordance with the present invention sulfided or sulfurized phenols and oligomers thereof as well as mixtures containing same are converted by treatment with alkyl vinyl ethers to compositions which are non-corrosive to copper or copper containing alloys or provide substantially lowered corrosivity to such metals or alloys without significant impairment of their antioxidant, antiwear or other desirable lubricant additive properties. This makes possible the formulation of improved lubricant compositions which were heretofore not feasible because of the corrosive properties of prior art sulfurized phenols.

The conversion may be carried out by a catalyzed or non-catalyzed addition of sulfided phenol to alkyl vinyl ethers or the alkyl vinyl ethers may be added to the sulfurized phenols. The additions may be, carried out in successive steps, employing different alkyl vinyl ethers or alternatively to a mixture of different ethers.

Generally speaking, the phenols e.g., p-tertiary-alkylphenols or 2,4-di-alkylphenols) or commercial phenol sulfides or sulfurized phenols in accordance herewith may be prepared by initially reacting phenol with a sulfur monohalide (e.g., sulfur monochloride); the product of which is then reacted with an alkyl vinyl ether (e.g., ethyl vinyl ether). The resulting product will usually still contain a substantial amount of hydroxyl groups. This product may be further reacted with additional alkyl vinyl ether (it may be the same or a different vinyl ether), at a higher temperature or the entire treatment with the alkyl vinyl ethers may, alternatively be carried out in one step. In the course of this treatment to remove or reduce the corrosivity of the sulfurized phenols as indicated above some or all of the phenolic hydroxyl groups may undergo reaction and the reactions may or may not be catalyzed. Choice of solvent as well as the presence or absence of a catalyst seems to effect the efficiency of the treatment.

The sulfurized phenols in accordance with this invention may be derived from any suitable phenol or mixtures of phenols. Although the phenols may be alkylated in any ring position, preferred phenols are 4-tertiary-alkylphenols wherein the alkyl moiety contains from 1 to about 20 carbon atoms. More preferred are 4-tertiary-alkylphenols where the alkyl group is derived from propylene trimer and tetramer, and butylene dimer and trimer. Most preferred are 4-tertiary-nonylphenol derived from propylene trimer and 4-tertiary-octylphenol derived from diisobutylene. Preferred sulfurized phenols include 2,2'-thiobis (alkylphenols) and 2,2'-dithiobis (alkylphenols) and oligomers thereof or mixtures of phenolic monosulfides, disulfides and polysulfides.

The alkyl vinyl ethers preferred for use herein contain from 1 to about 12 carbon atoms in the alkyl substituent. More preferred are $C_1$–$C_6$ vinyl ethers. Most preferred are ethyl and butyl vinyl ethers.

As previously stated the treatment or conversion reaction can be catalyzed or uncatalyzed. Lower monocarboxylic acids, i.e., from $C_1$ to about $C_4$, such as acetic acid have proven suitable. However, useful catalysts are not limited thereto, as for example, acid-containing ion-exchange resins, such as Amberlyst 15, have also been successfully used. Therefore, any suitable catalyst known in the art may be used. The reaction may take place in the presence of a solvent if so desired. A non-exhaustive list of suitable solvents includes benzene, toluene and xylene.

Reaction conditions may vary from a temperature of about 20° C. to about 150° C. Molar ratios of reactants will generally be as follows: from 0.1 to about 20:1 of the alkyl vinyl ether to the sulfurized phenol. Usually the reaction will be carried out at atmospheric pressure, however, higher pressures may be used if so desired. The reaction times may vary depending on the molar ratios of reactants, reaction temperatures, and presence or absence of a catalyst. Usually reaction times will vary from about 0.25 hour to about 10 hours.

The additives of this invention or mixtures thereof may be used in mineral oils, synthetic oils or mixtures of mineral and synthetic oils of lubricating viscosity. Amounts from about 0.1 to about 5 wt. % of the total composition are highly effective for the intended purpose. Also, lubricant compositions comprising a major proportion of an oil of lubricating viscosity or solid lubricant such as a grease prepared therefrom or various functional fluids, such as hydraulic fluids, transmission fluids, brake fluids, power steering fluids and heat transfer fluids and a minor effective proportion of an additive in accordance with the present invention may also contain other known additives for their intended purposes such as co-antioxidants including phenol sulfides and hindered phenols, dispersants, detergents and corrosion inhibitors in amounts of up to 10–20 wt. % of the total composition.

DESCRIPTION OF SPECIFIC EMBODIMENTS

Having generally described the invention the following specific material and examples are merely exemplary of the invention and no limitations, express or otherwise, are intended thereby.

EXAMPLE 1

A typical solvent refined mineral oil base stock having a viscosity of 200 SUS at 100° F.

EXAMPLE 2

Reaction of 2-Methyl-4-tert-butylphenol with Sulfur Monochloride. To a solution of 2-methyl-4-tert-butylphenol (82.2 g) in petroleum ether (200 ml) cooled to 8° C. there was added over about 5 hrs. sulfur monochloride (33.7 g). The temperature was maintained at 6°–8° C. After an additional 20 hrs. the reaction mixture cooled in an ice bath was treated with dilute ammonium hydroxide and extracted with benzene. Removal of solvent from the washed and dried benzene extract left the sulfurized phenol, 93 g of reddish oil. Elemental analysis gave C, 67.66; H, 7.92; S, 15.0; and Cl, 0.1 percent.

EXAMPLE 3

Reaction of Sulfurized 2-Methyl-4-tert-butylphenol with Butyl Vinyl Ether.

To a solution of sulfurized 2-methyl-4-tert-butylphenol (17.5 g) prepared as described in Example 2 in benzene (200 ml), containing one drop of glacial acetic acid as catalyst and heated at reflux temperature, there was added a solution of butyl vinyl ether (40 g) in petroleum ether (50 ml). The addition required 0.75 hr; the temperature was maintained at 76° C. during addition and for an additional 2 hr. reaction period. The reaction mixture was washed with water, neutralized with sodium bicarbonate solution, washed again with water and dried. Solvents and unreacted butyl vinyl ether were stripped off in a rotary film evaporator at reduced pressure leaving the reaction product as a moderately viscous amber oil.

EXAMPLE 4

Sulfurized 4-tert-Octylphenol.

Sulfur monochloride (50.6 g) was added over 5 hrs. to a stirred solution of 4-tert-octylphenol (154.7 g) in n-octane (150 ml) while the temperature was maintained at 125°–127° C. After an additional 0.25 hr. of heating the reaction mixture was allowed to cool to room temperature. The reaction mixture was then poured while stirring into a solution of ammonium hydroxide (150 ml). The resulting mixture was extracted with benzene. The extracts were washed with water and dried. Solvent was removed in a rotary film evaporator under reduced pressure leaving the sulfurized 4-tert-octylphenol as dark viscous oil containing 14.5% of sulfur.

EXAMPLE 5

Reaction of Sulfurized 4-tert-Octylphenol with Ethyl Vinyl Ether.

To a solution of sulfurized 4-tert-octylphenol (44.3 g) prepared as in Example 4 in xylene (200 ml) heated to 100° C. there was added during 3 hours while stirring, ethyl vinyl ether (50 g). The rate of addition was controlled so as to maintain the temperature for one hour more, and then solvent and unreacted vinyl ether were removed by rotary distillation at reduced pressure. The treated sulfurized phenol was obtained as a hazy oil residue which contained substantial hydroxyl absorption in the infrared spectrum. It was filtered to remove a minor amount (0.3 g) of solids melting above 300° C.

EXAMPLE 6

Preparation of Mixed Sulfurized 2-tert-butyl-4-methylphenol and p-Cresol.

To a solution of 2-tert-butyl-4-methylphenol (65.7 g) and p-cresol (21.6 g) in n-octane (150 ml) heated at 125° C. there was added during 1.5 hr. a solution of sulfur monochloride (54 g) in n-octane (50 ml). After addition was completed the reaction mixture was stirred at 125° C. for about one additional hour and then poured into a mixture of ammonium hydroxide (150 ml) and ice. The resulting organic-aqueous mixture was extracted several times with benzene. The combined extract was washed with water, dried and stripped of solvent by rotary evaporation. The residue, a phenol sulfide comprising an average structure of two o-tert-butyl-p-methylphenol end groups and a center p-cresol with two ortho sulfide-disulfide-polysulfide bridges each with an average of 1.5 sulfur atoms was obtained as a viscous dark oil.

Calculated for $C_{28}H_{33}O_3S_3$: C, 65.46; H, 6.47; S, 18.7. Found: C, 65.60; H, 8.27; S, 17.7.

EXAMPLE 7

Butyl Vinyl Ether treated Sulfurized Phenol from Mixed 2-tert-Butyl-4-methylphenol and p-Cresol.

To a solution of sulfurized phenol prepared from a mixture of 2-tert-butyl-4-methylphenol and p-cresol as described in Example 6 (32 g) in benzene (250 ml) heated to 84° C., butyl vinyl ether (50 g) was added during 1 hr. while stirring. Heating and stirring of the mixture at 84° C. was continued for 2.5 hr., and then solvent and unreacted butyl vinyl ether were removed by rotary film evaporation under reduced pressure. The product was obtained as a dark viscous oil which contained unreacted hydroxyl groups.

EXAMPLE 8

2,2'-Thiobis -(4-tert-octylphenol).

2,2'-thiobis-(4-tert-octylphenol) was prepared by reaction of 4-tert-octylphenol (p-1,1,3,3-tetramethylbutylphenol prepared by alkylation of phenol with diisobutylene) with sulfur dichloride as described in U.S. Pat. No. 2,971,940.

EXAMPLE 9

Ethyl Vinyl Ether and Butyl Vinyl Ether Sequentially Treated 2,2'-thiobis-(4-tert-octylphenol).

Following the method of Example 3, 2,2'-thiobis-(4-tert-octylphenol) (44.3 g) and ethyl vinyl ether were reacted in benzene using acetic acid as catalyst at 76°-80° C. After reaction and removal of benzene and unreacted ethyl vinyl ether, the product still contained a substantial amount of unreacted phenolic hydroxyl groups (infrared spectrum). This product was taken up in benzene heated at 80° C. with butyl vinyl ether (5 g) being added during 0.5 hr. Heating at 80° C. was continued for 2.25 hrs. and the reaction was worked up as in Example 3. The sequential ethyl vinyl ether—butyl vinyl ether treated phenol sulfide product was obtained as a dark viscous oil.

EXAMPLE 10

Reaction of Sulfurized 4-tert-Octylphenol with Ethyl Vinyl Ether.

To a solution of sulfurized 4-tert-octylphenol (44.3 g) prepared by the method Example 4 in benzene (200 ml) there was added during more than 3 hrs. a solution of ethyl vinyl ether (50 g) in benzene (about 125 ml) at such a rate as to maintain the reaction temperature at 76°-80° C. After addition, the reaction mixture was heated at reflux for 1.5 hrs. and worked up. After rotary evaporation of unreacted ethyl vinyl ether and xylene solvent at reduced pressure, the hazy residue was taken up in n-pentane, filtered and the solvent stripped again by rotary evaporation at reduced pressure leaving the treated sulfurized phenol (45 g) as a moderately viscous oil residue.

Certain of the examples were then subjected to the aforementioned Copper Strip Test after being incorporated into the above-referred to base oil (Example 1). The test data contained in the Table below clearly demonstrates the excellent anti-copper corrosion characteristics of the additives disclosed herein.

The test employed for this purpose was a standard ASTM Test D-130 which, in general, comprises immersion of a polished copper strip in the material to be tested for a period of 3 hrs. at a temperature of 250° F. At the end of this period the copper strip is removed, washed, and rated for degree of corrosion by comparison with the ASTM standard strips.

In accordance with the data set forth in Table 1, a series of comparative corrosion tests were carried out for the purpose of demonstrating the aforementioned improved corrosion-inhibiting effect realized in employing the aforementioned compounds of this invention. Additionally certain of the above-described examples were subjected to a Catalytic Oxidation Test to demonstrate the antioxidation properties of the present invention as well as to the 4-Ball Wear Test to demonstrate antiwear capability. Test procedures are given below. The data is set forth in Tables 2 and 3 below.

Catalytic Oxidation Test Procedure

The Catalytic Oxidation Test is to determine lubricants antioxidant properties. The test lubricant composition is subjected to a stream of air which is bubbled through the composition at a rate of 5 liters per hour at 325° F. for 40 hours. Present in the composition are metals commonly used as materials of engine construction, namely:

(a) 15.6 sq. in. of sand-blasted iron wire,
(b) 0.78 sq. in. polished copper wire,
(c) 0.87 sq. in. of polished aluminum wire, and
(d) 0.167 sq. in. of polished lead surface.

Inhibitors for oil are rated on the basis of prevention of oil deterioration as measured by the increase in acid formation or neutralization number (NN) and kinematic viscosity (KV) occasioned by the oxidation. The most important consideration being degree of viscosity increase or change. Table 2 summarizes the results.

The product of Example 9 was tested in the 4-Ball Test using a modified 4-Ball machine. In this test, three stationary balls are placed in a lubricant cup and a lubricant containing the additive to be tested is added thereto. A fourth ball is placed on a chuck mounted on a device which can be used to spin the ball at known speeds and loads.

In this test 100 cc of a lubricating oil comprising an 80-20 mixture, respectively, of 150" solvent paraffinic bright mineral oil (at 210° F.) and 200" solvent paraffinic neutral mineral oil (at 100° F.) was used. It contained 1.0% by weight of the product of Example 9. Table 3 summarizes the results. The smaller the scar the greater the antiwear effect.

TABLE 1

Copper Strip Test 3 Hr., 250° F.

| Before Alkyl Vinyl Ether Treatment | | | After Alkyl Vinyl Ether Treatment | | |
|---|---|---|---|---|---|
| Example No. | Additive Conc., Wt. % | Rating | Example No. | Additive Conc. wt. % | Rating |
| 1 (Base Oil) | — | | | | |
| 2 | 1 | 4C/4B | 3 | 1 | 1A |
| 4 | 1 | 4A | 5 | 1 | 1A |
| 6 | 2 | 4C | 7 | 1 | 1A |
| | 1 | 4C | | 1 | 1A |
| 8 | 1 | 1A | 9 | 1 | 1A |

TABLE 2

Catalytic Oxidation Test 350° F., 40 Hrs.

| Example No. | Conc. Wt. % | ΔNN | ΔKV % | Lead Loss, mg. |
|---|---|---|---|---|
| 1 | — | 17 | 334 | 66 |
| 2 | 2 | 0.96 | 29 | 0 |
| | 1 | 1.0 | 21 | 0 |
| 3 (Example 2 treated | 2 | 0.74 | 29 | 0.2 |
| with Butyl vinyl ether) | 1 | 1.8 | 26 | 0 |
| 4 | 1 | 0.70 | 23 | 0 |
| | 0.5 | 1.3 | 22 | 0 |
| 10 (Example 4 treated | 1 | 3.0 | 36 | 3 |
| with Ethyl vinyl ether) | 0.5 | 4.4 | 40 | 1.7 |
| 6 | 1 | 0.31 | 27 | 0 |
| | 0.5 | 0.84 | 20 | 0 |
| 7 (Example 6 treated | 1 | 0.46 | 22 | 0 |
| with butyl vinyl ether) | 0.5 | 0.71 | 10 | 0 |

TABLE 3

4-Ball Wear Test

| Base Oil | 200° F. 1500 RPM | 2000 RPM | 390° F. 1500 RPM |
|---|---|---|---|
| No Additive | *1.86 | 2.23 | 2.06 |
| Base oil containing 1% by weight of Additive of Example 9 | *1.63 | 1.10 | 1.90 |

*scar diameter in millimeters

The data set forth in the tables clearly show the multifunctional capabilities of the additive compounds of the present invention, i.e., the compounds disclosed herein possess antioxidant, antiwear and anticorrosion properties. For example after alkyl vinyl treatment (1) all of the examples tested showed the excellent copper corrosivity rating of 1 A, the lower the rating the better the anticorrosion properties; (2) all of the examples tested showed negligible or no lead loss, the lower the lead loss the better antioxidant protection provided; and (3) all the examples tested in the 4-Ball Wear Test provided significant reduction, under identical conditions, of scar diameter, the lower the scar diameter the better the antiwear protection.

It is understood, however, that while the invention has been described with reference to preferred embodiments departure therefrom can be readily made and is within the scope of the specification.

I claim:

1. A method of improving and/or substantially eliminating the metal corrosivity of sulfurized phenols by treating said sulfurized phenols or mixtures thereof with a $C_1$–$C_{20}$ alkyl vinyl ether said treatment comprising contacting said phenol with said ether in a suitable reaction zone at a temperature of from about 20° to 150° C. in a mole ratio of alkyl vinyl ether to sulfurized phenol of from about 0.1 to about 20:1 and thereafter isolating and recovering said treated sulfurized phenol.

2. The method of claim 1 wherein said sulfurized phenol is selected from the group consisting of phenolic monosulfides, disulfides and polysulfides, or mixtures thereof, and 2,2'-thiobisalkylphenols, 2,2'-dithiobis alkylphenols and oligomers or mixtures thereof wherein said alkyl group contains from 1 to about 20 carbon atoms.

3. The method of claim 2 wherein said sulfurized phenols are treated with a $C_1$–$C_{12}$ alkyl vinyl ether.

4. The method of claim 1 wherein said sulfurized phenol is sulfurized 2-methyl-4-tertiary-butylphenol.

5. The method of claim 4 wherein said sulfurized phenol is treated with butyl vinyl ether.

6. the method of claim 1 wherein said sulfurized phenol is sulfurized 4-tertiary-octylphenol.

7. The method of claim 6 wherein said sulfurized phenol is treated with ethyl vinyl ether.

8. The method of claim 1 wherein said phenol is mixed 2-tertiary-butyl-4-methyl-p-cresol sulfurized phenol.

9. The method of claim 8 wherein said sulfurized phenol is treated with butyl vinyl ether.

10. The method of claim 2 wherein said sulfurized phenol is 2,2'-thiobis-(4-tertiary-octylphenol).

11. The method of claim 10 wherein said sulfurized phenol is sequentially treated with ethyl vinyl ether and butyl vinyl ether.

12. The method of claim 1 wherein a catalyst is present.

13. The method of claim 12 wherein said catalyst is selected from a $C_1$–$C_4$ monocarboxylic acid.

14. The method of claim 13 wherein said catalyst is acetic acid.

15. The method of claim 1 wherein a solvent is present, said solvent being selected from benzene, toluene and xylene.

16. The method of claim 1 wherein the sulfurized phenols are treated in the presence of a catalyst and/or a solvent.

* * * * *